US005463279A

United States Patent [19]

Khormaei

[11] Patent Number: 5,463,279

[45] Date of Patent: Oct. 31, 1995

[54] ACTIVE MATRIX ELECTROLUMINESCENT CELL DESIGN

[75] Inventor: Iranpour Khormaei, Beaverton, Oreg.

[73] Assignee: Planar Systems, Inc., Beaverton, Oreg.

[21] Appl. No.: 293,144

[22] Filed: Aug. 19, 1994

[51] Int. Cl.[6] ..... H01J 9/00

[52] U.S. Cl. ..... 315/169.3; 315/169.1; 313/509

[58] Field of Search ..... 315/169.3, 56, 315/76, 160, 169.1, 51; 340/825.81, 825.91; 313/498, 506, 509

[56] References Cited

U.S. PATENT DOCUMENTS

| | | | |
|---|---|---|---|
| 4,006,383 | 2/1977 | Luo et al. | 315/169 TV |
| 4,528,480 | 7/1985 | Unagami et al. | 315/169.1 |
| 5,302,966 | 4/1994 | Stewart | 345/76 |

OTHER PUBLICATIONS

T. P. Brody, et al., A 6×6–in. 20–lpi Electroluminescent Display Panel, IEEE Transactions on Electron Devices, vol. ED–22, No. 9, Sep. 1975.

Ken–ichi Oki, et al., MOS–EL Integrated Display Device, Society for Information Display Digest 1982, pp. 245–246.

Keiji Nunomura, et al., TFEL Character Module Using a Multilayer Ceramic Substrate, Society for Information Display Digest 1987, pp. 299–302.

Takashi Unagami, et al., High Voltage TFT Fabricated in Recrystallized Polycrystalline Silicon, IEEE Transactions on Electron Devices, vol. 35, No. 3, Mar. 1988, pp. 314–319.

J. Vanfleteren, et al., Evaluation of a 64×64 CdSe TFT Addressed Actfel Display Demonstrator, pp. 134–136, 1991.

Z. K. Kun, et al., Thin–Film Transistor Switching of Thin–Film Electroluminscent Display Elements, pp. 236–242, 1980.

T. Suzuki, et al., Late–News Paper: The Fabrication of TFEL Displays.Driven by a–Si TFTs, pp. 344–347, 1992.

*Primary Examiner*—Robert J. Pascal
*Assistant Examiner*—David Vu
*Attorney, Agent, or Firm*—Chernoff, Vilhauer et al.

[57] ABSTRACT

An electroluminescent device comprises a plurality of layers including at least a transparent electrode layer, a circuit layer, and typically three layers including an electroluminescent layer sandwiched between front and rear dielectric layers, all three layers thereof disposed between the circuit layer and the transparent electrode layer. The circuit layer further comprises a first gating device coupled to a data line and a select line and having an output coupled to an input of a charge storage device. The charge storage device has a terminal connected to a first ground layer. A second gating device comprises a transistor operating in a breakdown region. The transistor has a gate coupled to the input to the charge storage device and has a first terminal coupled to a second ground layer and a second terminal coupled to a pixel electrode. The transparent electrodes are carrying an electrical signal such that upon activation of the second gating device an electric field is generated between the transparent electrode layer and the pixel electrode so as to cause the electroluminescent layer to emit light.

24 Claims, 4 Drawing Sheets

ACTIVE MATRIX ELECTROLUMINESCENT CELL DESIGN

BACKGROUND OF THE INVENTION

The present invention relates to a thin-film electroluminescent device for providing an improved optical display and more particularly to an improved active matrix thin film electroluminescent device (AMEL) for use as an optical display.

In general, AMEL displays are constructed of a thin-film laminar stack comprising a set of transparent front electrodes carrying an illumination signal, which are typically indium tin oxide deposited on a transparent substrate (glass). A transparent electroluminescent phosphor layer is sandwiched between front and rear dielectric layers, all of which is deposited behind the front electrodes. Pixel electrodes are deposited on the rear dielectric layer, typically consisting of a pad of metal or poly-silicon, positioned at each location a pixel is desired within the phosphor layer. An insulator made of any suitable material, such as $SiO_2$ or glass, is deposited on the pixel electrodes and exposed rear dielectric layer. The insulator layer is preferably constructed with holes in the insulator layer commonly referred to as VIA for each pixel electrode, to permit the connection of the pixel electrodes to a circuit layer which is deposited on the insulator layer. The circuit layer permits the individual addressing of each pixel electrode. As such, an individual pixel within the electroluminescent layer may be selectively illuminated by the circuit layer permitting a sufficient electrical field to be created between the front electrodes and the respective pixel electrode.

Referring to FIG. 1, an electrical schematic of an AMEL device is shown. A circuit layer 10 for selectively illuminating a respective pixel, is constructed with a low voltage transistor 12, that is designed to handle signals up to the range of about 20 volts, to gate a data signal (voltage signal) from a data line 14 connected to the low voltage transistor's source 16 to the low voltage transistor's drain 18. The drain 18 is connected to a hold capacitor 20 which in turn is connected to a ground line 26. In an actual fabricated AMEL device, the capacitor 20 is not generally fabricated as a discrete element, but is the capacitance of the line 40 between the low voltage transistor's drain 18 and the high voltage transistor's gate 30, coupled to the ground line 26. The gate 22 of the low voltage transistor 12 is connected to a select line 24 for activating the low voltage transistor 12 to permit selective gating of the data signal to the hold capacitor 20 for temporary storage. After gating the data signal to the hold capacitor 20, the select line 24 is typically then deselected, thereby, isolating the hold capacitor 20 from the data line 14. The capacitor 20 maintains the applied voltage for a period of time sufficient for the illumination of a pixel. The capacitor 20 is also connected to the gate 30 of a high voltage transistor 28, which is designed to withstand voltages in the range of about 200 volts (which typically is the maximum voltage applied to a display). Fabricating a high voltage transistor to maintain about 200 volts between its terminals is difficult and expensive. Such high voltage transistors also require a significant amount of area that may not be available when high resolution displays are constructed. Further, the high voltage transistors may not be as reliable as needed for cost effective manufacturing.

The high voltage transistor's source 29 and drain 31 are respectively connected between the ground line 26 and a pixel electrode 32. The front electrodes 34 carry a high AC voltage illumination signal powered by a signal driver 36. By activating the gate 30 of the high voltage transistor 28 with the electrical charge stored in the capacitor 20, after the low voltage transistor 22 has been deactivated, or by the data signal directly when the low voltage transistor 12 is activated, the pixel electrode 32 is electrically connected to the ground line 26 through transistor 28. By connecting the pixel electrode 32 to the ground line 26 a sufficient electric field is created between the respective portion of the front electrodes 34 and the pixel electrode 32, causing light to be emitted from the interposed electroluminescent layer 38.

A disadvantage of using this particular circuit design, in addition to the problems associated with the high voltage transistor 30, is that each line, namely the ground line 26, data line 14, select line 24, and front electrodes 34 (illumination line), each requires a level of metalization during the fabrication of the display, and with it the associated cost and process complexity to implement each level of metalization. If one or more lines could be eliminated, then a decrease in the manufacturing cost and process complexity might be realized.

Referring to FIG. 2, a modified design of the circuit layer 10 is shown that does eliminate a metalized line. The modified design involves connecting the source 57 of the high voltage transistor 54 to the data line 55 and the capacitor 56 to ground. This circuit layer 50 reduces the required number of lines from four to three by elimination of the ground line 26. This design works adequately at low refresh rates. However, this design seriously limits maximum refresh rate achievable because the data signal cannot be stored in the capacitor 56 simultaneously with the illumination of the pixel due to the connection of the high voltage transistor 54 with the data line 55. As an illustration of the problem, if a high data bit is written to the data line 55, the low voltage transistor 58 will apply a charge to the capacitor 56 if the select line 61 activates the gate 59 of the low voltage transistor 58. This in turn imposes a high voltage at the gate 66 of the high voltage transistor 54. The high voltage transistor 54 will not be activated because the high data bit data signal is also simultaneously imposed on the drain 57 of the high voltage transistor 54. This causes the respective pixel in the phosphor layer, to be turned off if it was previously on, or, if it was previously off to delay illuminating (turned on) because a sufficient electric field will not be created between the front electrodes 65 and the respective pixel electrode 64 until the high voltage transistor 54 is activated. However, the high voltage transistor 54 will not be activated until a high voltage is at the high voltage transistor's gate 66 and the data line 55 is grounded.

The limitation of not having the capability of simultaneously writing data and illuminating the respective pixel reduces the illumination time of the pixel by the period of time required to write the data. This limitation is minor when low refresh rates are used, but becomes pronounced when employing high refresh rates, such as when a temporal gray scale approach is used, because the whole display needs to be updated by the number of gray scales desired during each screen refresh. In other words, when using a gray scale display, the pixels need to be turned on and off at a much higher rate than would normally be the case, and the time period necessary to write the data becomes more significant with respect to the illumination time.

Additionally, the reduction in the illumination time proportionately decreases the maximum possible brightness of the display and also requires faster data update rates due to the shorter time allowed. Furthermore, since the data line 55 is used to both write the data and sink large electroluminescent currents when the high voltage transistor 54 is activated, the data line 55 will need to be a low resistance line to be able to accommodate the increased current levels. However, such low resistance data lines 55 are difficult to fabricate. Furthermore, a higher sinking capability is required for a driver 60 controlling the data line 55.

Vanfleteren, et al., Evaluation Of A 64×64 CdSe TFT Addressed ACTFEL Display Demonstrator, discloses in FIG. 1 a two transistor-two capacitor circuit for driving an AMEL electroluminescent device. In this circuit design, $C_v$ is provided between the high voltage transistor and the electroluminescent stack to reduce the voltage on the high voltage transistor when it is off. A voltage divider is formed with $C_{El}$ and $C_v$ in a manner so that the high voltage transistor does not operate in the breakdown region because traditional wisdom is that the high voltage transistor will self-destruct if required to do so. With large pixels, such as those in the Vanfleteren disclosure, there is a high capacitance value which causes peak currents that may be too large for the high voltage transistors to handle. Additionally, using large pixels increases the chances of microscopic shorts that can result in a direct current destroying the high voltage transistor. The fabrication of $C_v$ also takes a significant amount of area, additional processing, and is a high voltage capacitor that could fail reducing the yield of manufacturing.

Referring to FIG. 2 of Vanfleteren, et al., the structure of the AMEL device is constructed by starting with a glass layer and then proceeding to deposit an ITO, dielectric, phosphor, and dielectric layer. Then, the pixel electrodes are deposited on the last dielectric layer followed by a sandwiched layer structure of a first $Al_2O_3$ layer, a second $Al_2O_3$ layer and a grounded electrode layer between the first and second $Al_2O_3$ layers. Deposited on the second $Al_2O_3$ layer are the individual circuit elements forming a circuit layer. Large voltages are present during the operation of the display between the ITO and the pixel electrodes that produce stray voltages that could easily interfere with the transistors, particularly the low voltage transistor in the circuit layer. The interposed grounded electrode layer between the $Al_2O_3$ layers acts to shield the circuit layer from the stray voltages, thus reducing the likelihood of interference with the operation of the circuit layer. The second $Al_2O_3$ layer will inherently have a significant number of microscopic defects due to depositing it on the grounded electrode layer which limits how small the individual circuit elements may be and still function. As described in Vanfleteren, the low power memory TFT has channel dimensions of W×L=25 μm×125 μm which is totally unacceptable when constructing a high resolution display. Such channel dimensions and the circuit used in Vanfleteren will probably only give a maximum resolution of around 100 pixels per inch.

What is desirable is a display structure that minimizes the number of lines required in an AMEL circuit layer and permits the use of significantly smaller transistors and other circuit elements, so that high resolution displays up to the range of 2,000 pixels per inch can be manufactured. Further, the design should provide for high maximum refresh rates to accommodate a high gray scale.

SUMMARY OF THE PRESENT INVENTION

The present invention overcomes the aforementioned drawbacks of the prior art by providing an electroluminescent device that comprises a plurality of layers including at least a transparent electrode layer, a circuit layer, and at least two layers including an electroluminescent layer and a dielectric layer, said at least two layers disposed between the circuit layer and the transparent electrode layer. The circuit layer further comprises a first gating device coupled to a data line and a select line and having an output coupled to an input of a charge storage device. The charge storage device has a terminal connected to a first ground layer. A second gating device comprises a transistor operating in a breakdown region. The transistor has a gate coupled to the input to the charge storage device and has a first terminal coupled to a second ground layer and a second terminal coupled to a pixel electrode. The transparent electrode layer carrying an electrical signal such that upon activation of the second gating device an electric field is generated between the transparent electrode layer and the pixel electrode so as to cause the electroluminescent layer to emit light.

The circuit design eliminates the prior need for the inclusion of a capacitance between the second gating device and the pixel electrode which takes up unnecessary area that is needed when constructing high resolution displays. The number of metalization lines is minimized by the elimination of the ground line and by using a ground layer instead. Also, the processing difficulties associated with fabricating high voltage capacitors and the possible reductions of overall manufacturing yields is reduced. Further, the high voltage capacitor does not need to maintain a full 200 volts by designing the circuit to permit it to operate in the breakdown region.

In a preferred embodiment of the present invention, the circuit layer is deposited on a rearwardly disposed substrate and the first grounded terminal and the second grounded terminal are electrically connected to the substrate layer. A ground plane is sandwiched between front and rear insulator layers, all three layers thereof disposed between the electroluminescent layer and the circuit layer.

Inclusion of the substrate layer, which is typically a highly pure and nearly defect free material, allows the circuit layer to be designed with smaller gating devices than could previously be used. The use of small gating devices and other small electrical devices in the circuit layer permits a high definition display to be constructed in the range of 2,000 pixels per inch.

The foregoing and other objectives, features, and advantages of the invention will be more readily understood upon consideration of the following detailed description of the invention, taken in conjunction with the accompanying drawings.

DETAILED DESCRIPTION OF THE INVENTION

An improved circuit design will first be described, thereafter an improved laminar stack structure intended primarily for the improved circuit design will be described.

Figure 1:
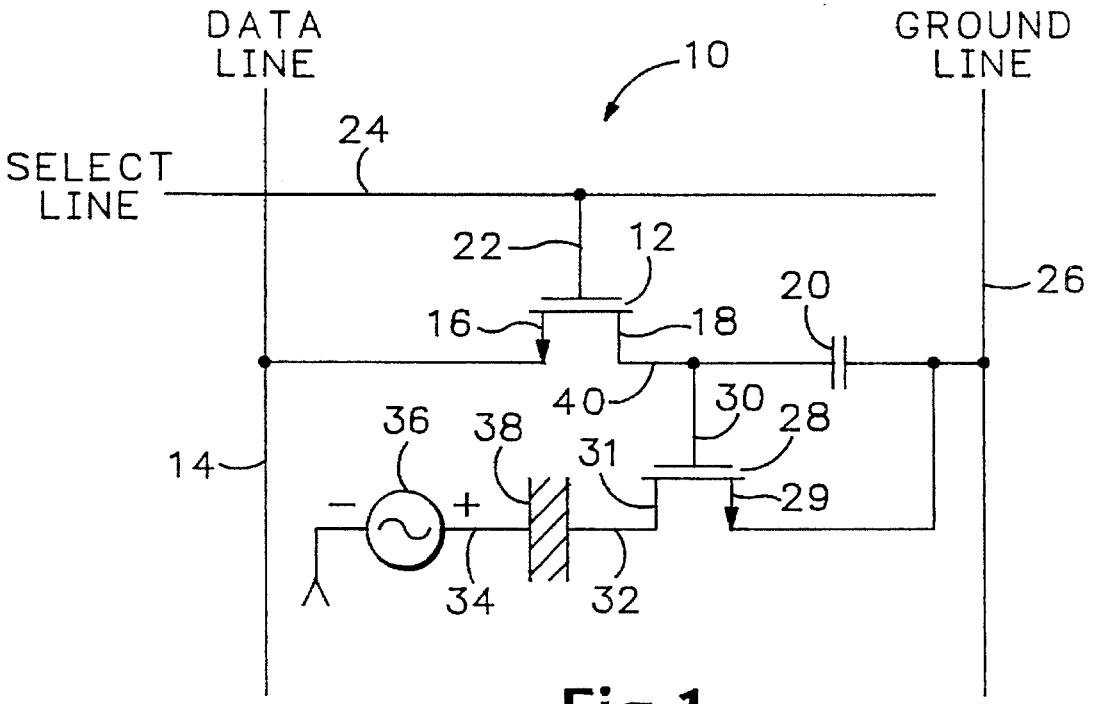
FIG. 1 is an electrical schematic of an AMEL circuit design including a ground line.
Figure 2:
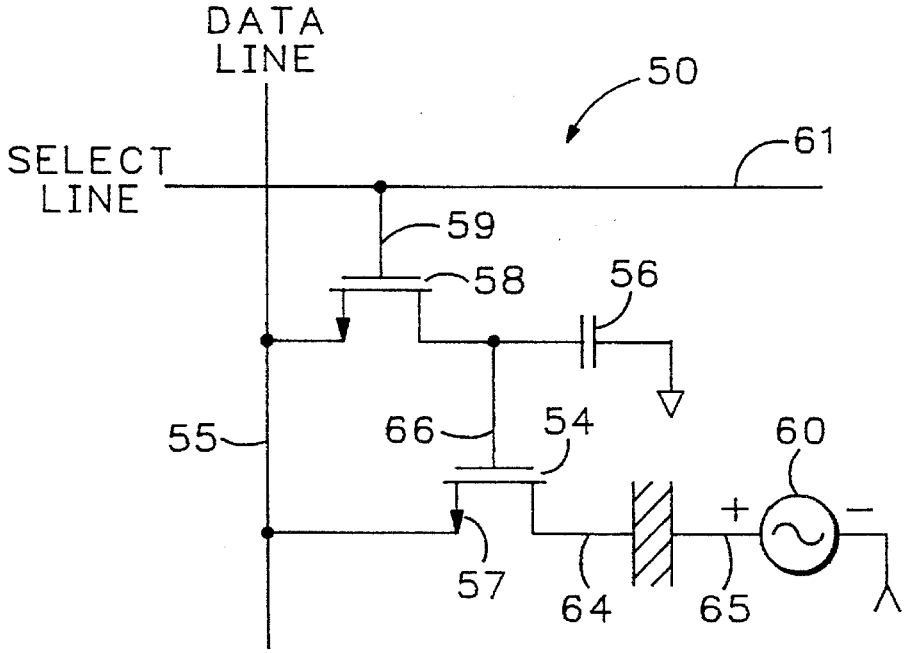
FIG. 2 is an electrical schematic of an AMEL circuit design wherein the source of a high voltage transistor is connected to the data line.
Figure 3:
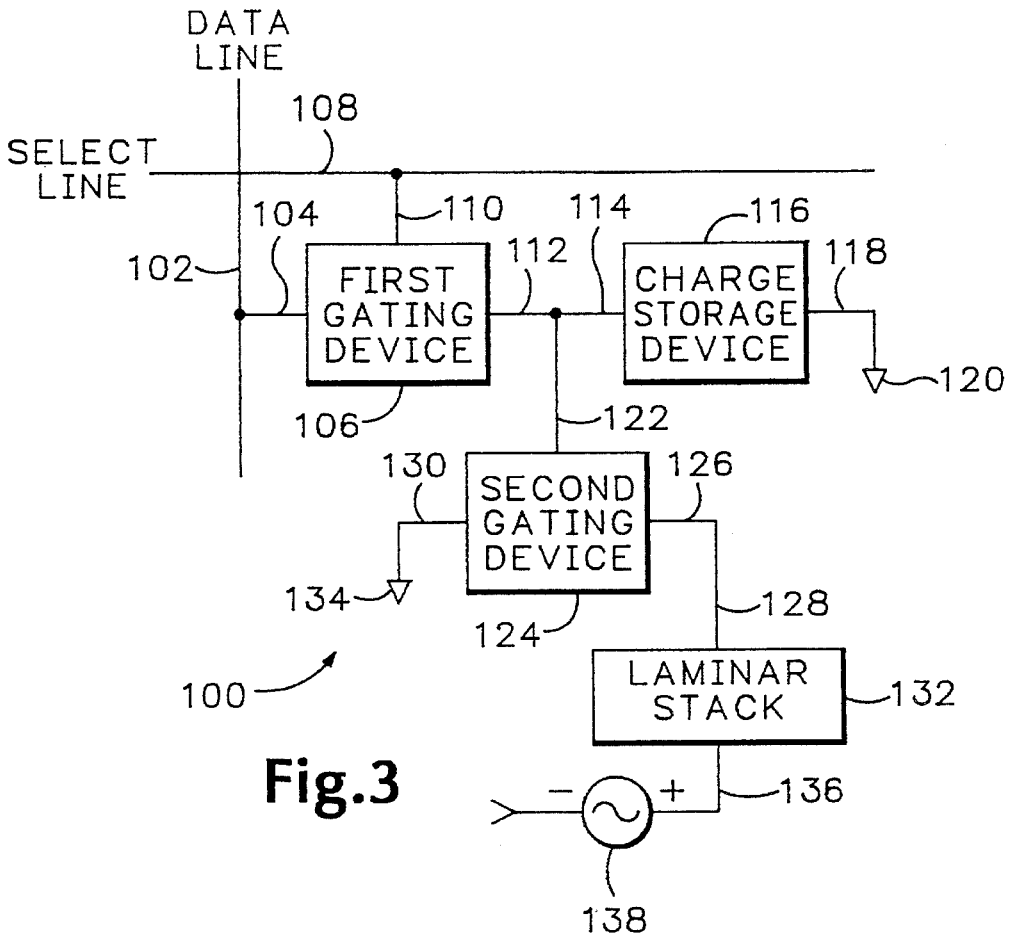
FIG. 3 is a block diagram of an exemplary embodiment of an AMEL circuit design constructed according to the invention.

Referring to FIG. 3, an improved circuit layer 100 is shown for an active matrix thin film electroluminescent device (AMEL) that may be fabricated for constructing high resolution displays in the range of 2,000 lines per inch. Such displays are preferably used in head mounted or projection type displays. The circuit layer comprises a data line 102 that is electrically connected to an input terminal 104 of a first gating device 106. A select line 108 is electrically connected to a first select input 110 of the first gating device 106. To operate the first gating device 106, the select line is activated permitting a signal (voltage signal) from the data line 102 to be electrically connected to an output terminal 112 of the first gating device 106. The output terminal 112 is electrically connected to a first terminal 114 of a charge storage device 116. The charge storage device 116 stores the electrical charge imposed on the first terminal 114 between the first terminal 114 and a first grounded terminal 118 of the charge storage device 116. The first grounded terminal 118 is electrically connected to a first ground layer 120. The first ground layer 120 is any suitable layer of material in the laminar stack of the thin film electroluminescent device that can provide an adequate ground. The preferred ground is a rearwardly disposed substrate layer or a grounded plane of the laminar stack, both described later. As such, the first grounded terminal 118 does not require a separate ground line to be included, as shown in FIG. 1, which would otherwise increase the cost and process complexity of the display. In an actual fabricated AMEL display, the charge storage device 116 is not generally fabricated as a discrete element, but rather is the capacitance between a ground layer and the line between the output terminal 112 and a second select input 122 of a second gating device 124.

The first terminal 114 is also electrically connected to the second select input 122 of the second gating device 124. A pixel terminal 126 of the second gating device 124 is electrically connected to a pixel electrode 128 in the laminar stack 132. The display is designed to be used as a high resolution display, so the pixel electrodes 128 are preferably sized to be on the order of about 22 μm×22 μm in size. The pixel electrodes 128 may be sized in the general range of 10 μm×10 μm to 50 μm×50 μm. The second gating device 124 should comprise a transistor operating in a breakdown region to maintain a predetermined voltage between a second grounded terminal 130 of the second gating device 124 and the pixel terminal 126 when the second select input 122 is deactivated. The electroluminescent phosphor layer of the laminar stack 132 emits light when a voltage is applied in the range of around 120 volts to 200 volts (typically the maximum used) across the phosphor layer. As such, the second gating device 124 should be designed to maintain a voltage around 80 volts or more to prevent the electroluminescent phosphor layer from emitting light. As such, the voltage swing imposed on the phosphor layer from full on (200 volts) to full off (0 volts) in the laminar stack 132 will only be 120 volts if the high voltage transistor is maintained at 80 volts while the pixel is off. By using small pixel electrodes, the electroluminescent layer acts as a small high quality capacitor, which in reality limits the currents through the second gating device 124 (which is commonly a transistor), thereby creating an operable design. Therefore, a voltage division circuit is not used to prevent the high voltage transistor from operating in the breakdown region. With the small high quality electroluminescent capacitor limiting the current, a high voltage transistor with an 80 volt breakdown voltage may be used. Such 80 volt transistors are more reliable than higher voltage transistors and require less area to fabricate which is critical in extremely high resolution displays. If the same high voltage transistor were used in a traditional lower resolution display employing larger pixel electrodes which inherently have a much higher capacitance value, the peak currents might be too large for the high voltage transistor causing its self-destruction as the conventional wisdom dictates. Further, using larger pixel electrodes increases the chances of microscopic shorts that could result in a direct current path which could destroy the high voltage transistor.

The second gating device 124 also operates in a conducting mode to electrically connect the second grounded terminal 130 to the pixel terminal 126 by activation of the second select input 122. Likewise, the second grounded terminal 130 is connected to a second ground layer 134. The second ground layer 134 may be the same or a different layer from that of the first ground layer 120. Grounding the second grounded terminal 130 permits the simultaneous illumination of a pixel with the writing of the data. This is critical for high refresh rates, especially when employing a high gray scale. The transparent electrodes 136 carry an electrical signal from a signal driver 138 such that upon an activation of the second gating device 124 an electric field is generated between a transparent electrode layer in the laminar stack 132 and the pixel electrode 128, so as to cause the electroluminescent layer to emit light.

Figure 4:
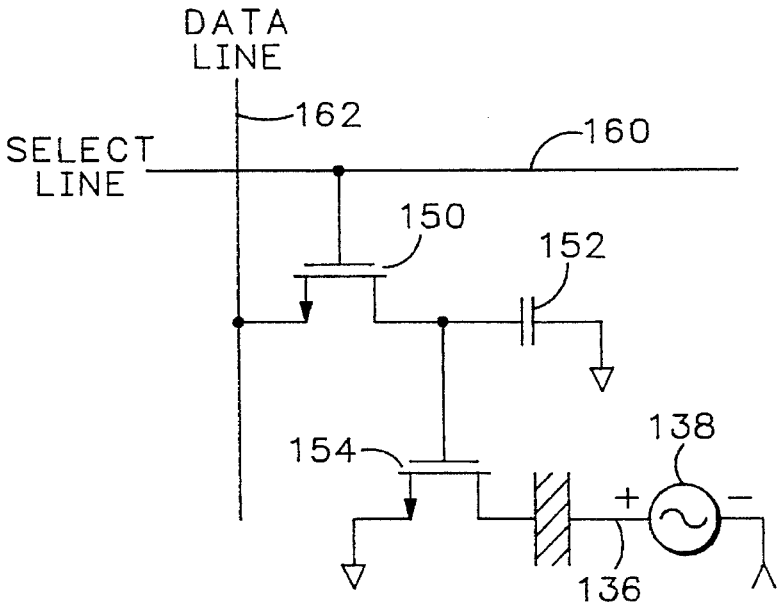
FIG. 4 is an exemplary electrical schematic diagram of the AMEL circuit of FIG. 3.

FIG. 4 is an electrical schematic of FIG. 3, with the first gating device 106 replaced by a transistor 150, the charge storage device 116 replaced by a capacitor 152, and the second gating device 124 replaced by a transistor 154. It is preferable that the transistors are fabricated using MOS technology, but other types of transistors may also work such as bipolar, CMOS, FET, JFET or Bi-CMOS. The transistor 150 is preferably a low voltage transistor capable of handling voltages up to about 10 volts so that its size can be minimized.

Figure 5:
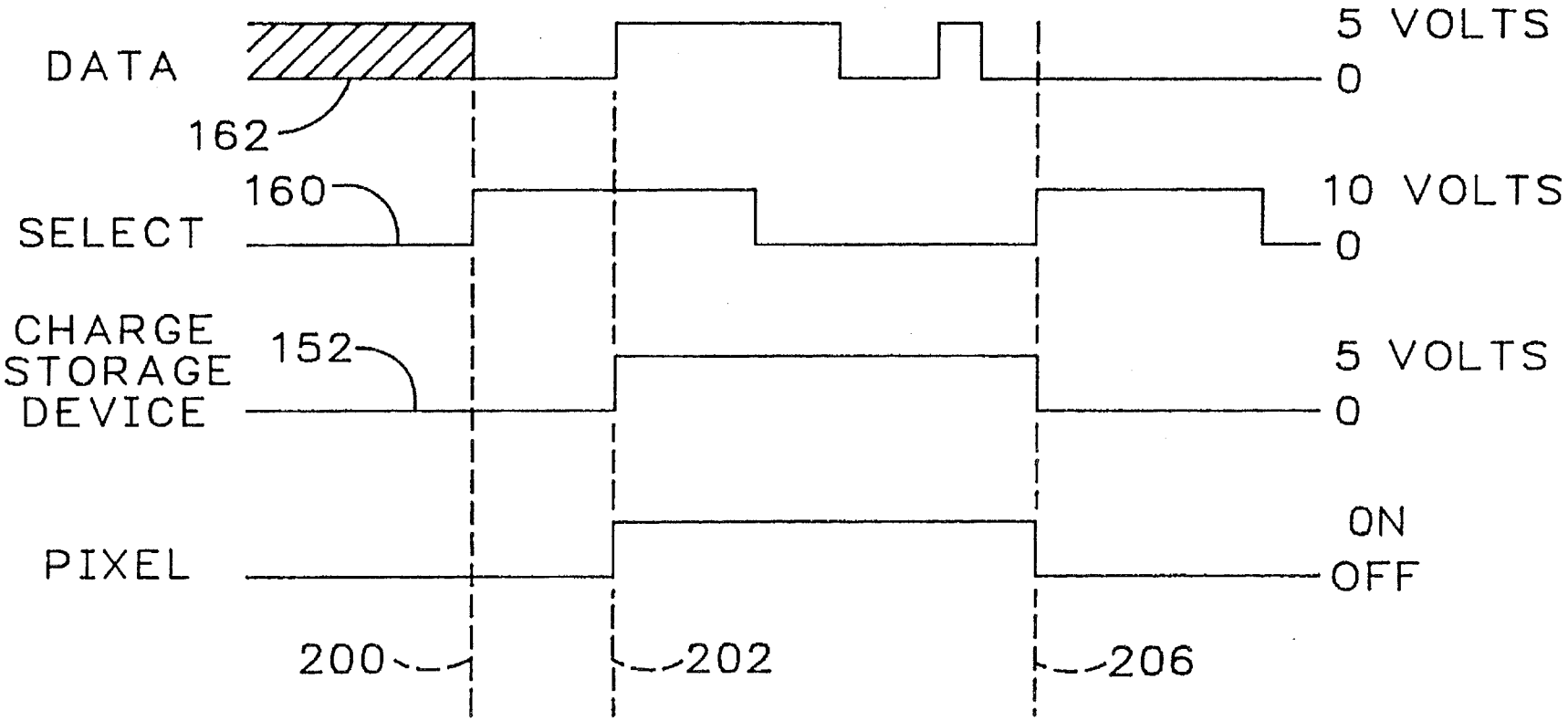
FIG. 5 is a timing diagram for the circuit design shown in FIG. 4.

Referring to FIG. 5, a timing diagram is shown for FIG. 4 having N-channel MOS transistors. Briefly describing some timing transitions, when the select line 160 switches from low to high at time 200 the data line 162 is maintaining the capacitor 152 with a low voltage causing the respective pixel not to emit light. At time 202 the select line is high and the data line 162 switches from low to high causing the charge storage device 152 to charge, thereby, causing the respective pixel to emit light. The pixel will continue to emit light until time 206, even though there are changes in the voltage level of the data line 162 because these switches occur while the select line 160 is deactivated. At time 206, the select line switches high while the data line is low causing the capacitor 152 to switch low, thereby, turning off the respective pixel.

Figure 6:
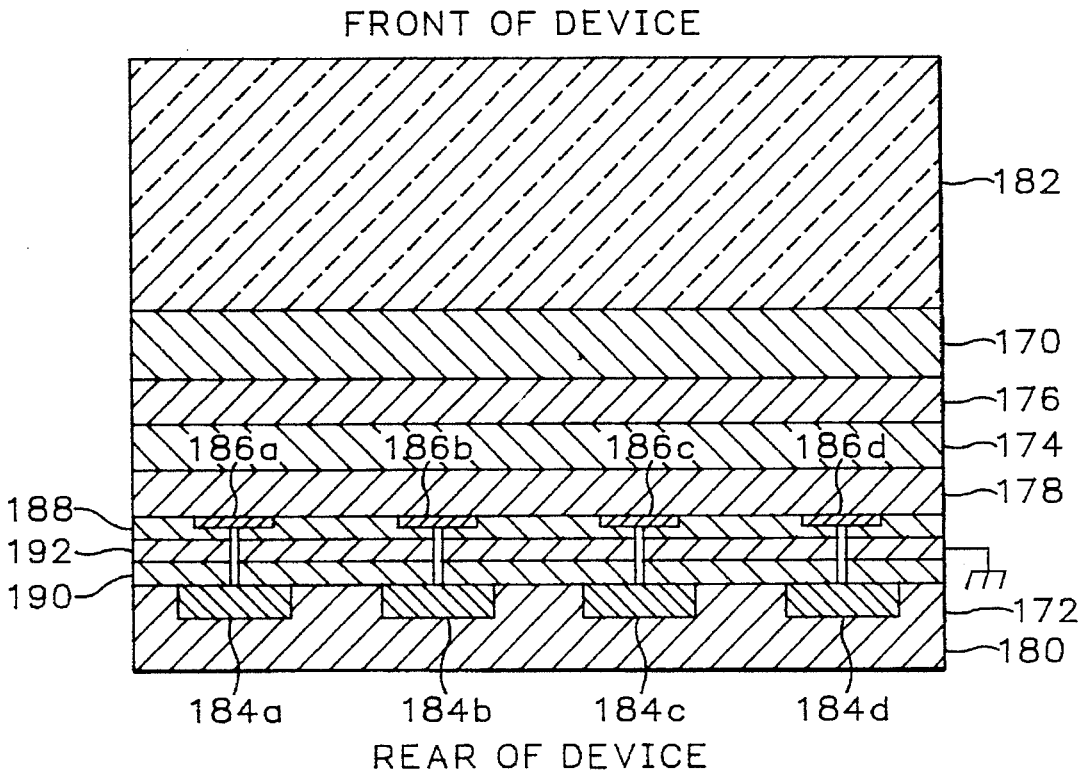
FIG. 6 is a cut away sectional representation of an exemplary inverted structure AMEL device constructed in accordance with the present invention.

Referring to FIG. 6, an AMEL device is constructed using an inverted structure. A plurality of layers is provided including at least a transparent electrode layer 170, a circuit layer 172, and typically three layers including an electroluminescent phosphor layer 174 sandwiched between front and rear dielectric layers 176 and 178, all three layers being placed between the circuit layer 172 and the transparent electrode layer 170. The circuit layer is fabricated on a rearwardly disposed substrate 180. The rearwardly disposed substrate is preferably a high purity silicon in which the circuit layer 172 is fabricated. Then a front glass plate 182 is attached. The preferred fabrication technique is ALE (atomic layer epitaxy). Other fabrication processes may also be acceptable. The design of the circuit layer, as shown in FIG. 4, is such that the size and area required for the electrical devices is reduced to permit a display in the range of 2,000 lines per inch to be fabricated. The preferred layout has the low voltage transistor fabricated to be 5 μm×15 μm which is a significant decrease in size from transistors previously used. Small transistors in the range of 5 μm×15 μm deposited on the dielectric layer would not function because of the defects inherently present in the deposited dielectric layer. Inverted structure AMEL displays have not previously been designed because conventional displays typically only require a resolution of 100 lines per inch, which is obtainable by depositing the circuit layer on the dielectric layer and glass substrate which avoids the expense of providing a large silicon substrate.

The individual circuit elements 184*a*, 184*b*, 184*c* and 184*d* are connected to respective pixel electrodes 186*a*, 186*b*, 186*c* and 186*d*, with a metal line connected through a hole in the interdisposed layers, commonly referred to as VIA, to permit connection. The interdisposed layers are a first isolation layer 188, a second isolation layer 190, with an interdisposed ground plane 192 preferably of aluminum. The isolation layers 188 and 190 are preferably made out of glass or $SiO_2$. During operation of the display, high voltages will be present at the pixel electrodes 186*a–d* which may cause interference with the transistors in the circuit layer 172. By providing the ground plane 192, the voltages at the pixel electrodes will be shielded from the circuit elements 184*a–d*. This is particularly important for the low voltage transistor because it operates with a smaller voltage margin. The grounding for the circuit layer 184*a–d* is preferably the rearwardly disposed substrate layer 180 or the ground plane 192. Also, a large ground plane 192 helps increase the reliability of using a high voltage transistor with a lower breakdown voltage, such as a 80 volt transistor. Additionally, a good ground plane 192 or substrate 180 permits a higher resistance data line 102 to be used.

In an alternative embodiment of the present invention either the rear dielectric layer or the front dielectric layer may be omitted.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. In an electroluminescent device comprising a plurality of layers including at least a transparent electrode layer, a circuit layer, and at least two layers including an electroluminescent layer and a dielectric layer said at least two layers thereof disposed between said circuit layer and said transparent electrode layer, the improvement comprising:

(a) said circuit layer further including:

(i) a first gating device coupled to a data line and a select line and having an output coupled to an input of a charge storage device, said charge storage device having a terminal connected to a first ground layer;

(ii) a second gating device comprising a transistor operating in a breakdown region, said transistor having a gate coupled to said input to said charge storage device and having a first terminal coupled to a second ground layer and a second terminal coupled to a pixel electrode; and (b) said transparent electrodes carrying an electrical signal such that upon activation of said second gating device an electric field is generated between said transparent electrode layer and said pixel electrode so as to cause said electroluminescent layer to emit light.

2. The device of claim 1 further comprising, said circuit layer deposited on a rearwardly disposed substrate.

3. The device of claim 2 wherein said first ground layer and said second ground layer are said substrate.

4. The device of claim 1 further comprising at least three additional layers, including a ground plane sandwiched between front and rear insulator layers, all three layers thereof disposed between said electroluminescent layer and said circuit layer.

5. The device of claim 2 wherein said second ground layer is sandwiched between front and rear insulator layers, all three layers thereof being disposed between said dielectric layer and said circuit layer.

6. The device of claim 2 wherein said first ground layer is sandwiched between front and rear insulator layers, all three layers disposed between said dielectric layer and said circuit layer.

7. The device of claim 1 wherein said pixel electrode is on the order of 22 μm×22 μm in size.

8. The device of claim 1 wherein said first gating device comprises a transistor that is on the order of 5 μm×15 μm in size.

9. An electroluminescent device comprising:

(a) a plurality of layers including at least a transparent electrode layer, a circuit layer, and at least two layers including an electroluminescent layer and a dielectric layer, said at least two layers disposed between said circuit layer and said transparent electrode layer;

(b) said circuit layer deposited on a rearwardly disposed substrate; and (c) said circuit layer further comprising:

(i) a first gating device electrically connecting a data line to a charge storage device by activation of a select line;

(ii) said charge storage device electrically connected between a first ground layer and a second gating device;

(iii) said second gating device electrically connecting a pixel electrode to a second ground layer by activation of said charge storage device;

(d) said transparent electrodes carrying an electrical signal such that upon activation of said second gating device, an electric field is generated between said transparent electrode layer and said pixel electrode so as to cause said electroluminescent layer to emit light.

10. In an electroluminescent device comprising a plurality of layers including at least a transparent electrode layer, a circuit layer, and at least three layers including an electroluminescent layer sandwiched between front and rear dielectric layers, all three layers thereof disposed between said circuit layer and said transparent electrode layer the improvement comprising:

(a) said circuit layer deposited on a rearwardly disposed substrate;

(b) said circuit layer further including:

(i) a first gating device coupled to a data line and a select line and having an output coupled to an input of a charge storage device, said charge storage device having a terminal connected to a first ground layer;

(ii) a second gating device comprising a transistor operating in a breakdown region, said transistor having a gate coupled to said input to said charge storage device and having a first terminal coupled to a second ground layer and a second terminal coupled to a pixel electrode;

(c) said first ground layer and said second ground layer are said substrate; and (d) said transparent electrodes carrying an electrical signal such that upon activation of said second gating device an electric field is generated between said transparent electrode layer and said pixel electrode so as to cause said electroluminescent layer to emit light.

11. In an electroluminescent device comprising a plurality of layers including at least a transparent electrode layer, a circuit layer, and at least three layers including an electroluminescent layer sandwiched between front and rear dielectric layers, all three layers thereof disposed between said circuit layer and said transparent electrode layer the improvement comprising:

(a) said circuit layer further including:

(i) a first gating device coupled to a data line and a select line and having an output coupled to an input of a charge storage device, said charge storage device having a terminal connected to a first ground layer;

(ii) a second gating device comprising a transistor operating in a breakdown region, said transistor having a gate coupled to said input to said charge storage device and having a first terminal coupled to a second ground layer and a second terminal coupled to a pixel electrode;

(b) at least three additional layers, including a ground plane sandwiched between front and rear insulator layers, all three layers thereof disposed between said rear dielectric layer and said circuit layer; and (c) said transparent electrodes carrying an electrical signal such that upon activation of said second gating device an electric field is generated between said transparent electrode layer and said pixel electrode so as to cause said electroluminescent layer to emit light.

12. In an electroluminescent device comprising a plurality of layers including at least a transparent electrode layer, a circuit layer, and at least three layers including an electroluminescent layer sandwiched between front and rear dielectric layers, all three layers thereof disposed between said circuit layer and said transparent electrode layer the improvement comprising:

(a) said circuit layer deposited on a rearwardly disposed substrate;

(b) at least three additional layers, including a ground plane sandwiched between front and rear insulator layers, all three layers thereof disposed between said rear dielectric layer and said circuit layer;

(c) said circuit layer further including:

(i) a first gating device coupled to a data line and a select line and having an output coupled to an input of a charge storage device, said charge storage device having a terminal connected to said substrate;

(ii) a second gating device comprising a transistor operating in a breakdown region, said transistor having a gate coupled to said input to said charge storage device and having a first terminal coupled to said ground plane and a second terminal coupled to a pixel electrode; and (d) said transparent electrodes carrying an electrical signal such that upon activation of said second gating device an electric field is generated between said transparent electrode layer and said pixel electrode so as to cause said electroluminescent layer to emit light.

13. In an electroluminescent device comprising a plurality of layers including at least a transparent electrode layer, a circuit layer, and at least three layers including an electroluminescent layer sandwiched between front and rear dielectric layers, all three layers thereof disposed between said circuit layer and said transparent electrode layer the improvement comprising:

(a) said circuit layer deposited on a rearwardly disposed substrate;

(b) at least three additional layers, including a ground plane sandwiched between front and rear insulator layers, all three layers thereof disposed between said rear dielectric layer and said circuit layer;

(c) said circuit layer further including:

(i) a first gating device coupled to a data line and a select line and having an output coupled to an input of a charge storage device, said charge storage device having a terminal connected to a said ground plane;

(ii) a second gating device comprising a transistor operating in a breakdown region, said transistor having a gate coupled to said input to said charge storage device and having a first terminal coupled to said substrate and a second terminal coupled to a pixel electrode; and (d) said transparent electrodes carrying an electrical signal such that upon activation of said second gating device an electric field is generated between said transparent electrode layer and said pixel electrode so as to cause said electroluminescent layer to emit light.

14. In an electroluminescent device comprising a plurality of layers including at least a transparent electrode layer, a circuit layer, and at least two layers including an electroluminescent layer and a dielectric layer, said at least two layers thereof disposed between said circuit layer and said transparent electrode layer the improvement comprising:

(a) said circuit layer deposited on a rearwardly disposed substrate;

(b) said circuit layer further including:

(i) a first gating device coupled to a data line and a select line and having an output coupled to an input of a charge storage device, said charge storage device having a terminal connected to a first ground layer;

(ii) a second gating device comprising a transistor operating in a breakdown region, said transistor having a gate coupled to said input to said charge storage device and having a first terminal coupled to a second ground layer and a second terminal coupled to a pixel electrode;

(c) said first ground layer and said second ground layer are said substrate; and (d) said transparent electrodes carrying an electrical signal such that upon activation of said second gating device an electric field is generated between said transparent electrode layer and said pixel electrode so as to cause said electroluminescent layer to emit light.

15. In an electroluminescent device comprising a plurality of layers including at least a transparent electrode layer, a circuit layer, and at least two layers including an electroluminescent layer and a dielectric layer, said at least two layers thereof disposed between said circuit layer and said transparent electrode layer the improvement comprising:

(a) said circuit layer further including:

(i) a first gating device coupled to a data line and a select line and having an output coupled to an input of a charge storage device, said charge storage device having a terminal connected to a first ground layer;

(ii) a second gating device comprising a transistor operating in a breakdown region, said transistor having a gate coupled to said input to said charge storage device and having a first terminal coupled to a second ground layer and a second terminal coupled to a pixel electrode;

(b) at least three additional layers, including a ground plane sandwiched between front and rear insulator layers, all three layers thereof disposed between said dielectric layer and said circuit layer; and (c) said transparent electrodes carrying an electrical signal such that upon activation of said second gating device an electric field is generated between said transparent electrode layer and said pixel electrode so as to cause said electroluminescent layer to emit light.

16. In an electroluminescent device comprising a plurality of layers including at least a transparent electrode layer, a circuit layer, and at least two layers including an electroluminescent layer and a dielectric layer, said at least two layers thereof disposed between said circuit layer and said transparent electrode layer the improvement comprising: (a) said circuit layer deposited on a rearwardly disposed substrate;

(b) at least three additional layers, including a ground plane sandwiched between front and rear insulator layers, all three layers thereof disposed between said dielectric layer and said circuit layer;

(c) said circuit layer further including:

(i) a first gating device coupled to a data line and a select line and having an output coupled to an input of a charge storage device, said charge storage device having a terminal connected to said substrate;

(ii) a second gating device comprising a transistor operating in a breakdown region, said transistor having a gate coupled to said input to said charge storage device and having a first terminal coupled to said ground plane and a second terminal coupled to a pixel electrode; and (d) said transparent electrodes carrying an electrical signal such that upon activation of said second gating device an electric field is generated between said transparent electrode layer and said pixel electrode so as to cause said electroluminescent layer to emit light.

17. In an electroluminescent device comprising a plurality of layers including at least a transparent electrode layer, a circuit layer, and at least two layers including an electroluminescent layer and a dielectric layer, said at least two layers thereof disposed between said circuit layer and said transparent electrode layer the improvement comprising:

(a) said circuit layer deposited on a rearwardly disposed substrate;

(b) at least three additional layers, including a ground plane sandwiched between front and rear insulator layers, all three layers thereof disposed between said dielectric layer and said circuit layer;

(c) said circuit layer further including:

(i) a first gating device coupled to a data line and a select line and having an output coupled to an input of a charge storage device, said charge storage device having a terminal connected to a said ground plane;

(ii) a second gating device comprising a transistor operating in a breakdown region, said transistor having a gate coupled to said input to said charge storage device and having a first terminal coupled to said substrate and a second terminal coupled to a pixel electrode; and (d) said transparent electrodes carrying an electrical signal such that upon activation of said second gating device an electric field is generated between said transparent electrode layer and said pixel electrode so as to cause said electroluminescent layer to emit light.

18. In an electroluminescent device comprising a plurality of layers including at least a transparent electrode layer, a circuit layer, and at least two layers including an electroluminescent layer and a dielectric layer, said at least two layers thereof disposed between said circuit layer and said transparent electrode layer the improvement comprising:

(a) said circuit layer further including:

(i) a first gating device coupled to a data line and a select line and having an output coupled to an input of a charge storage device, said charge storage device having a terminal connected to a ground layer;

(ii) a second gating device comprising a transistor operating in a breakdown region, said transistor having a gate coupled to said input to said charge storage device and having a first terminal coupled to said ground layer and a second terminal coupled to a pixel electrode; and (b) said transparent electrodes carrying an electrical signal such that upon activation of said second gating device an electric field is generated between said transparent electrode layer and said pixel electrode so as to cause said electroluminescent layer to emit light.

19. The device of claim 18 further comprising, said circuit layer deposited on a rearwardly disposed substrate.

20. The device of claim 19 wherein said ground layer is said substrate.

21. The device of claim 18 further comprising at least three additional layers, including a ground plane sandwiched between front and rear insulator layers, all three layers thereof disposed between said dielectric layer and said circuit layer.

22. The device of claim 18 further comprising said ground layer sandwiched between front and rear insulator layers, all three layers thereof disposed between said dielectric layer and said circuit layer.

23. The device of claim 18 wherein said pixel electrode is on the order of 22 μm×22 μm in size.

24. The device of claim 18 wherein said first gating device comprises a transistor that is on the order of 5 μm×15 μm in size.

* * * * *